US006131247A

United States Patent [19]

Morita

[11] Patent Number: 6,131,247

[45] Date of Patent: Oct. 17, 2000

[54] MAGNETIC FIXING UNIT

[76] Inventor: Tamao Morita, 47-1, Arakawa 6-chome, Arakawa-ku, Tokyo, Japan

[21] Appl. No.: 09/334,620

[22] Filed: Jun. 17, 1999

[30] Foreign Application Priority Data

Jul. 9, 1998 [JP] Japan ..... 10-194638

[51] Int. Cl.[7] ..... A44B 21/00; E05C 17/56

[52] U.S. Cl. ..... 24/303; 292/251.5

[58] Field of Search ..... 24/303, 114.2, 24/66.1, 658, 683, 684, 689, 691, 667; 335/285, 236; 292/251.5

[56] References Cited

U.S. PATENT DOCUMENTS

| | | | |
|---|---|---|---|
| 4,453,294 | 6/1984 | Morita . | |
| 4,700,436 | 10/1987 | Morita . | |
| 5,125,134 | 6/1992 | Morita . | |
| 5,152,035 | 10/1992 | Morita . | |
| 5,199,138 | 4/1993 | Morita . | |
| 5,253,394 | 10/1993 | Morita . | |
| 5,274,889 | 1/1994 | Morita . | |
| 5,377,392 | 1/1995 | Morita . | |
| 5,515,581 | 5/1996 | Kauffmann | 24/303 |
| 5,572,772 | 11/1996 | Morita | 24/303 |
| 5,707,091 | 1/1998 | Morita . | |
| 5,868,445 | 2/1999 | Kaufman et al. | 24/303 |
| 5,937,487 | 8/1999 | Bauer | 24/303 |

*Primary Examiner*—Anthony Knight
*Assistant Examiner*—Robert J. Sandy
*Attorney, Agent, or Firm*—Patton Boggs LLP

[57] ABSTRACT

The magnetic fixing unit of the present invention comprises a first assembly which is attached to one member of a pair of members to be combined to each other, and a second assembly which is attached to the other member of said pair members. The first assembly comprises a magnet plate and an engaging portion, and the second assembly comprises a magnetic plate which is attracted to the magnet plate when said second assembly is combined with the first assembly, an engaging member made of magnetic material, which is located on the other side of said magnetic plate with respect to the magnet plate and is moved to a lock position for the engaging portion by an operation of the magnet plate when the second assembly is combined with the first assembly, and a slider which is applied to said engaging member to move said member from the lock position to a release position.

18 Claims, 4 Drawing Sheets

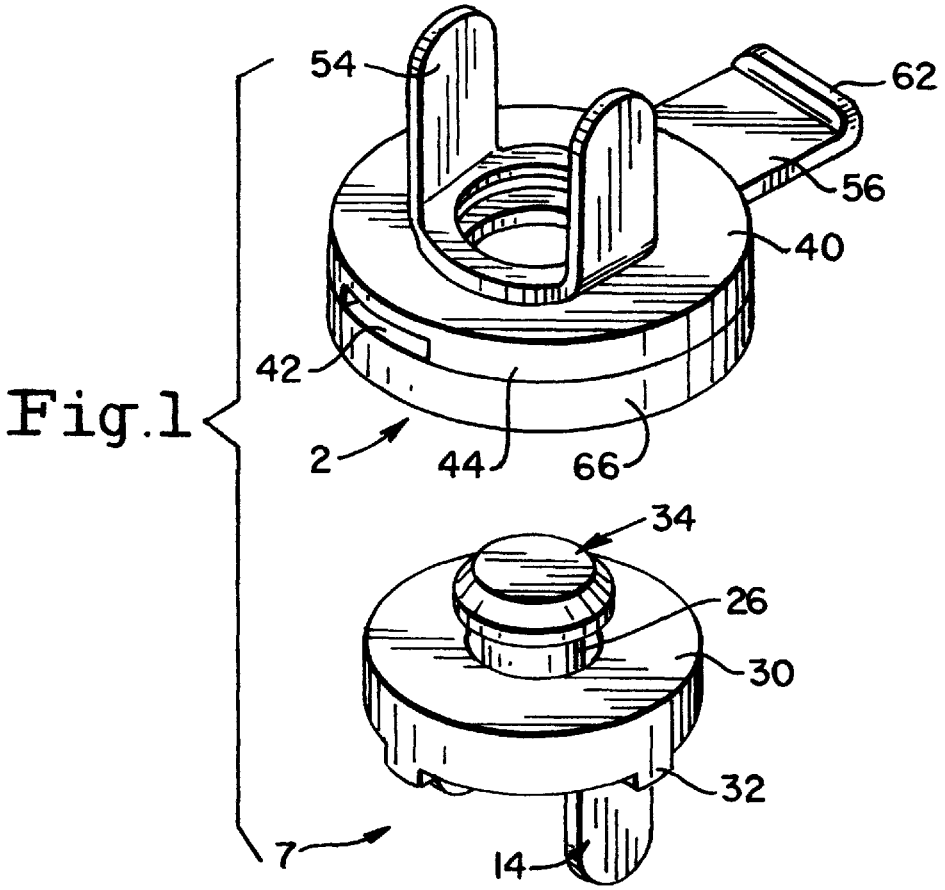
Fig.1
Fig.3
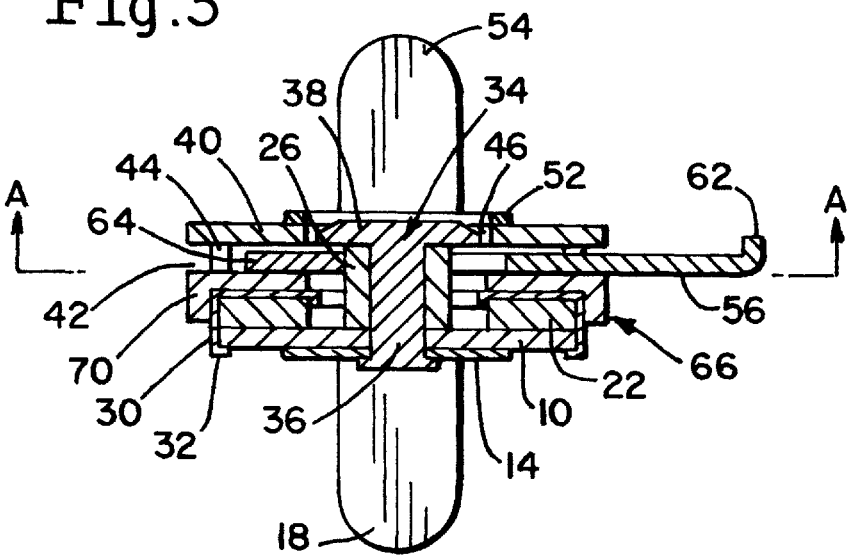

MAGNETIC FIXING UNIT

FIELD OF THE INVENTION

The present invention relates to a magnetic fixing unit, in particular, to a simplified magnetic fixing unit capable of automatically locking, for example, a handbag in a closed condition.

PRIOR ART

In order to keep the lid of, for example, a handbag, bag or knapsack in a closed condition, various kinds of fixing units have been designed and are available. One of them is a magnetic fixing unit using magnetic force.

Generally, the magnetic fixing unit keeps an object in a closed condition by the use of a characteristic of magnet, and particularly, the attracting force thereof. Accordingly, the magnetic fixing unit offers advantages of simpler structure and fails less than fixing units which only use mechanical operations. Magnetic fixing units have been proposed which keep the lid of a handbag, for example, in a closed condition by the use of the characteristic of magnet and, at the same time, accomplish an automatic locking by moving a locking member made of magnetic material by the use of a magnet.

However, this conventional type of fixing unit could not be put to practical use because the locking member was unable to make motion required by the application of a magnet's magnetic field to the locking member with various kind of forces or directions.

Accordingly, there has been a need and desire to develop a practical and simplified magnetic fixing unit with automatic locking mechanism.

PROBLEMS TO BE SOLVED BY THE INVENTION

The present invention is provided to solve the above mentioned problems, and the object thereof is to provide a practical and simplified magnetic fixing unit which can automatically lock a handbag, for example, in a closed condition using only properties of the magnet.

MEANS TO SOLVE THE PROBLEMS

According to one aspect of the present invention, there is provided a magnetic fixing unit comprising a first assembly which is attached to one member of a pair of members which are to be combined each other and a second assembly which is attached to the other member of said pair of members, said magnetic fixing unit characterized in that said first assembly comprises at least a fixing plate and an engaging portion formed on said fixing plate, and said second assembly comprises at least a magnetic plate which faces said fixing plate on one surface thereof when the second assembly is combined with the first assembly, an engaging member which is made of magnetic material and is located on the other side of said magnetic plate and may be moved to a lock position for said engaging portion when the second assembly is combined to the first assembly, and a release means which is applied to said engaging member to move it from said lock position to a release position, wherein a magnet plate which is located between said fixing plate and said magnetic plate when said first and said second assemblies are combined with each other is disposed on either of said first or said second assemblies, and said engaging member is designed so as to be movable to the lock position for said engaging portion by an operation of said magnet plate, and a substantially all of said magnet plate is placed between a plane formed by said fixing plate and an extension thereof and another plane formed by said magnetic plate and an extension thereof when the first and the second assemblies are combined each other.

According to an embodiment of the present invention, said magnet plate is place on said fixing plate.

According to another embodiment of the present invention, said fixing plate is made of magnetic material.

According to another embodiment of the present invention, a non-magnetic member is sometimes inserted into at least one of places between said release means and said magnetic plate, between said engaging member and said magnetic plate and between a set of said release means and said engaging member, and said magnetic plate.

According to another embodiment of the present invention, said non-magnetic member is a plating applied to at least one of said release means, said engaging member and said magnetic plate.

According to another embodiment of the present invention, said release means is a slider formed as a separated piece from said engaging member.

According to another embodiment of the present invention, said engaging member and said slider are formed in one body.

According to another embodiment of the present invention, said release means is formed as a part of said engaging member.

According to another embodiment of the present invention, said release means is made of magnetic material and a magnetic operating force applied by said engaging portion to said release means is reduced by recessing a part of said release means deeper toward farther direction from said engaging portion.

According to another aspect of the present invention, there is provided a magnetic fixing unit comprising a first assembly which is attached to one member of a pair of members which are to be combined each other and a second assembly which is attached to the other member of said pair members, said magnetic fixing unit characterized in that said first assembly comprises at least a fixing plate which is made of magnetic material and is fixed to said one member, an attracting portion for engaging member, which is made of magnetic material and extend upward from said fixing plate, and an engaging portion formed on said attracting portion for engaging member, and said second assembly comprises at least a frame fixed to said the other member, an engaging member which is made of magnetic material and is installed within said frame to be floatable, a release means installed to be movable with respect to said frame/and an attracting plate which is made of magnetic material and is installed on said frame so as to place said engaging member and said release means between said frame and said attracting plate, wherein a magnet plate is disposed on either of said first or said second assemblies so that said magnet plate is located between said fixing plate and said attracting plate when said first and said second assemblies are combined with each other, and said attracting plate is formed into a shape which allows said engaging portion and said attracting portion for engaging member of the first assembly to approach nearby said engaging member when said first and said second assemblies are combined each other, and said engaging member is moved, when the first and the second assemblies are combined, toward said attracting portion for engaging member in said frame by cooperative magnetic operation of said fixing plate, said magnet plate, said attracting portion for engaging member and said attracting plate to be engaged with said engaging portion, and thereby locks a combination of the first and the second assemblies, and said lock condition can be released by moving said release means to be applied to said engaging member, and a substantially all of said magnet plate is placed between a plane formed by said fixing plate and an extension thereof and another plane formed by said attracting plate and an extension thereof when the first and the second assemblies are combined each other.

According to an embodiment of the present invention, said magnet plate is placed on said fixing plate and said attracting portion for engaging member is extended upward from said fixing plate through said magnet plate to above a surface of said magnet plate.

According to another embodiment of the present invention, said fixing plate is made of magnetic material.

According to another embodiment of the present invention, a non-magnetic member is sometimes inserted into at least one of places between said release means and said attracting plate, between said engaging member and said attracting plate and between a set of said release means and said engaging member, and said attracting plate.

According to another embodiment of the present invention, said non-magnetic member is a plating applied to at least one of said release means, said engaging member and said attracting plate.

According to another embodiment of the present invention, said release means is a slider formed as a separated piece from said engaging member.

According to another embodiment of the present invention, said engaging member and said slider are formed in one body.

According to another embodiment of the present invention, said release means is formed as a part of said engaging member.

According to another embodiment of the present invention, said release means is made of magnetic material and a magnetic operating force applied by said attracting portion for engaging member to said release means is reduced by recessing a part of said release means-deeper toward farther direction from said attracting portion for engaging member.

BRIEF DESCRIPTION OF THE DRAWINGS

FIG. 1 is a perspective view of the magnetic fixing unit of the present invention illustrating an assembled condition thereof;

FIG. 3 is a cross sectional view illustrating an operation mechanism of the locking when the first and the second assemblies are combined each other;

FIG. 4(*b*) is a cross sectional view illustrating an operation of the embodiment shown in FIG. 4(*a*);

BRIEF DESCRIPTION OF REFERENCE NUMERALS

Figure 2:
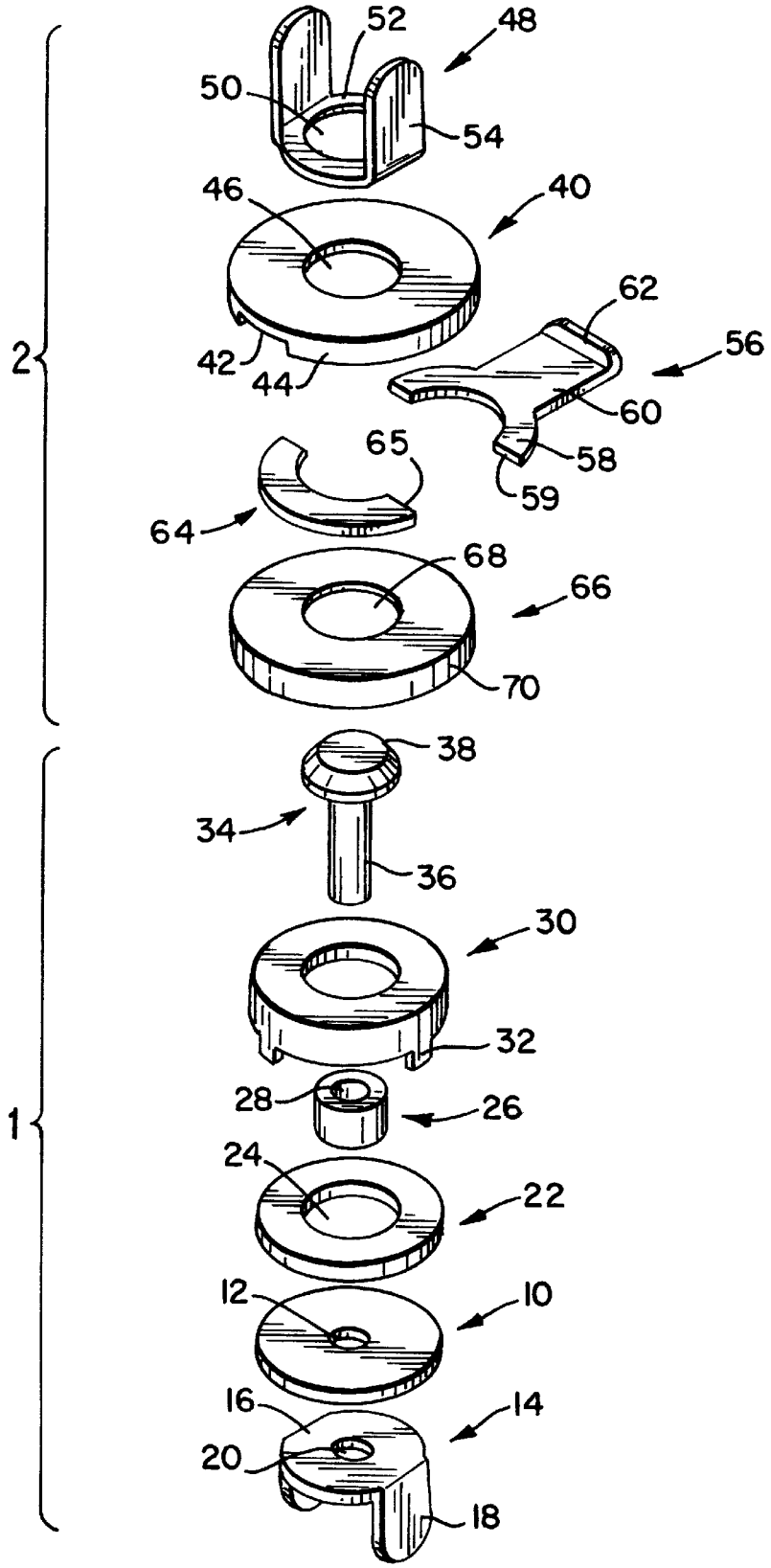
FIG. 2 is an exploded view in perspective of each of the first and the second assemblies.

1 first assembly
10 annular plate
14 retainer
22 ring magnet
26 cylindrical sleeve
30 cover
34 engaging pin
40 annular frame
48 retainer
56 slider
64 engaging member
66 attracting plate

DETAILED DESCRIPTION OF THE INVENTION

EMBODIMENT

There will now be described several preferred embodiments of the present invention.

FIG. 1 is a perspective view of an assembled magnetic fixing unit according to the present invention. As shown in the drawing, the magnetic fixing unit of the present invention comprises a first assembly 1 and a second assembly 2. Each of these pairs of assemblies is, as described later, fixed respectively to either one of a pair of mating members (for example, a main body and a lid of a handbag) of an object to be equipped with said magnetic fixing unit. Since these assemblies are mutually attracted and combined with each other by the operation of a magnet installed on the first assembly, the mating members of the handbag, for example, can be kept in closed condition through this combination. Specifically, the magnetic fixing unit of the present invention offers the advantage that it can be automatically locked by the operation of a magnet. This locked condition of the unit can be easily released by operation of the second assembly.

FIG. 2 is an exploded view in perspective of assemblies 1 and 2. This drawing shows components of each of the assemblies in detail. The details of the component of each of the assemblies will be described with reference to FIGS. 1 and 2.

The first assembly will be initially described.

As shown in a lower half of FIG. 2, by the bracketing numeral 1, the first assembly comprises an annular plate 10; a retainer 14 which is fixed to said annular plate 10, a ring magnet 22 and a cylindrical sleeve 26 which are attracted and attached onto the annular plate 10 by a magnetic force. A cover 30 which covers said ring magnet 22 and the annular plate 10 is also shown to be so formal to enable an engaging pin 34, see FIG. 1, to pass through the first assembly along a center thereof.

The annular plate 10 may be made either of a non-magnetic material such as plastics or a magnetic material. When, the annular plate 10, is made of iron a plating is usually applied thereto for anti-corrosion purposes. A plating may be applied as well to other metallic components for anti-corrosion purposes. A hole 12 formed on a center of the annular plate 10 enables the engaging pin 34 to be passed there through.

The retainer 14 is fixed onto the bottom of the annular plate 10 by welding, caulking or other appropriate methods. Further, the retainer 14 and the annular plate 10 do not have to be formed as separate components but may be formed into one body. The retainer 14 may be made from any appropriate material, however, when it is formed in one unit with the annular plate 10, it is naturally formed of the same as the annular plate.

The retainer 14 comprises an annular portion 16 and two fixing portions 18 which extend downward from opposite sides of said annular portion 16. The annular portion 16 of the retainer is fixed to the annular plate 10, while the fixing portions 18 are used to fix the first assembly to, for example, the main body or lid of a handbag. At the center of the annular portion 16 a hole 20, having approximately the same size as that on the annular plate 10 is formed. When the retainer 14—and the annular plate 10 are aligned with each other, the hole 20 of the annular portion 16—and the hole 12 of the annular plate 10 are aligned with each other, and thereby an aligning hole for the engaging pin 34 to be passed through is formed.

The ring magnet 22 is attached onto the opposite side of the annular plate 10 from that to which the retainer 14 is attached. Though, in the present embodiment, an outer diameter of the ring magnet 22 is approximately the same as that of the annular plate 10, the outer diameter of the ring magnet 22 may be, for example, less or more than that of the annular plate 10. Said ring magnet 22 is a permanent magnet which has a N-pole or S-pole on one side or surface thereof and the opposite polarity on the other side or surface. Therefore, the ring magnet 22 can be attracted and attached onto the annular plate 10 by its own magnetic force. As a result of the magnetic attraction and attachment of ring magnet 22 to annular plate 10, the annular plate 10 is magnetized and also generates a magnetic force. The magnetic force of the annular plate 10 has an important role, in particular, to attract the cylindrical sleeve 26.

The cylindrical sleeve 26, as shown in FIG. 2, will be attached to the same side of the annular plate 10 as ring magnet 22. While in the present embodiment, the cylindrical sleeve 26 is shown to be located near to the center of the annular plate 10, it need not be located at the center of the annular plate 10. When the cylindrical sleeve 26 is located near to the center of the annular plate 10, it is placed directly on the annular plate 10 so that it does not obstruct or interfere with an inner edge of a center hole 24 of the ring magnet 22. The cylindrical sleeve 26 need not necessarily be located away from the ring magnet 22, but may be brought into contact with the ring magnet 22.

The cylindrical sleeve 26, similar to annular plate 10, is made of magnetic material. Therefore, the cylindrical sleeve 26 can be attracted by and attached to the magnetized annular plate 10. It is obvious that, when the cylindrical sleeve 26 is attracted and attached to the annular plate 10 by magnetic force, the cylindrical sleeve 26 is also magnetized. As a result, the cylindrical sleeve itself generates a magnetic force. The magnetic force of the cylindrical sleeve has an extremely important role to attract the engaging member 64 as will be described later.

When the cylindrical sleeve 26 is magnetically attached onto the, annular plate 10, the top of the cylindrical sleeve 26 will project over the ring magnet 22. The cylindrical sleeve 26 also has a through hole 28 along a longitudinal direction thereof, whose size is almost the same as those of the hole 20 of the retainer 14 and the hole 12 of the annular plate 10. When all of the cylindrical sleeve 26, the annular plate 10 and the retainer 14 are aligned, these holes form an aligning hole to be penetrated by the engaging pin 34.

The cover 30 is attached to the ring magnet 22 and the annular plate 10. As shown in FIG. 2, cover 30 has a ring-shaped, corresponding to that of the ring magnet 22. The size thereof is suitable for covering almost of all the surface of the ring magnet 22 except bottom portion thereof, and a side surface of the annular plate 10. When the cover 30 is placed to cover the ring magnet 22 and 14 the annular plate 10, four fixing legs 32 extending downward from an outer periphery, of a bottom of said cover 30 are projected over the bottom surface of the annular plate 10. When these fixing legs are bent inward along the bottom surface of the annular plate 10, the cover 30 can be fixedly attached to the ring magnet 22 and the annular plate 10 making them to be integrated unit. Though the material of the cover 30 is not limited to a particular one, the present embodiment employs non-magnetic material such as brass. Therefore, the cover itself is not affected by the magnet. The reason why the cover 30 is provided is to protect the ring magnet 22 and the annular plate 10 and to make the connection there between stronger, so that the cover may be omitted. When there is no cover used, the ring magnet 22 and the annular plate 10 are preferably joined together by bonding or other known methods for making a stronger connection there between.

The engaging pin 34 is installed by being inserted into the aligning hole formed by respective holes of the cylindrical sleeve 26, the annular plate 10, and the retainer 14. The engaging pin 34 comprises a stem 36 and a head 38 formed on said stem 36. Only the stem 36 of the engaging pin 34 is inserted into the aligning hole and the head 38 is not inserted into said aligning hole.

The stem 36 of the engaging pin 34 is made to have a length that is longer than the total length of the aligning hole formed by the holes of the cylindrical sleeve 26 and the like. Therefore, when the stem 36 of the engaging pin 34 is inserted into the aligning hole, the tip of the stem 36 can be projected out of the hole 20 of the retainer 14 which forms the most bottom side of the aligning hole. By caulking the projected-out portion (not shown) of the stem 36 against the, bottom of the retainer 14, or by fixing the projected-out portion of the stem 36 to the retainer 14 using welding, screwing or other appropriate methods, the engaging pin 34 may be fixed to the annular plate 10 and the cylindrical sleeve 26. When the engaging pin 34 is fixed to The bottom of retainer 14, the end portion of the stem 36 of the engaging pin 34 may be flatten to be even with the bottom surface of the retainer 14 or may be formed to be slightly projected from said bottom surface.

When the engaging pin 34 is inserted through the aligning hole, the head 38 of the engaging pin 34 projects above the top of the cylindrical sleeve 26. At least a portion of the head 38 is made of non-magnetic material, and therefore is not affected by the magnetic force. As described later, when the first and the second assemblies are combined with each other, the head 38 penetrates a central portion of the second assembly, and since, as described previously, this head 38 is not affected by the magnetic force, a combining operation of the first and the second assembly is not achieved due to the head 38 being magnetically attracted by any parts of the second assembly. Other portion of the engaging pin 34 than the head 38, that is, the stem 36 may be made of magnetic material or of non-magnetic material. The reason why the head 38 of the engaging pin 34 is formed to have a conical surface is to make the head 38 to be easily inserted into the second assembly as described later.

The second assembly will now be described.

As shown in an upper portion of FIG. 2, by the bracketing numeral 2, the second assembly comprises an annular frame 40, a retainer 48 and an attracting plate 66 which are fixed to said annular frame 40, and a slider 56 and an engaging member 64 which are retained between the annular frame 40 and the attracting plate 66.

The annular frame 40 may be made of either non-magnetic material such as plastics or of magnetic material. Hole 46, formed on a central portion of the annular frame 40, receives the head 38 of the engaging pin 34, when the first and the second assemblies are combined. As a result of head 38 being received in hole 46, a mutual shifting between the first and the second assemblies may be prevented. The hole 46 may be used also to drain plating solution when the second assembly is plated.

The slider 56 and the engaging member 64 are held on the inside of the annular frame 40. In order to hold these components, an annular rim 44 having a predetermined height is formed on a periphery of the annular frame 40. The slider 56 and the engaging pin 34 are held in a housing space (see FIG. 4) formed by the annular rim 44 and a surface of the annular frame 40. The slider 56 and the engaging member 64 are held in said housing space so as to be able to move floatably.

The slider 56 comprises a half-moon portion 58 and a lever 60. Among these portions, what is held within the housing space formed by the annular frame 40 is the half-moon portion 58 and a small part of the lever 60, and the greater remaining part of the lever 60 projects outside of the annular frame 40. By operating said part of the lever 60 projecting outside of the housing 40, the half-moon portion 58 in the housing space can be controlled. In order to make the operation of the slider 56 to be easy, a tongue 62 is formed by bending an end of the lever 60. The slider 56 of the present invention is made of non-magnetic material. Therefore, the slider 56 itself is not affected by the magnetic force.

Figure 4A:
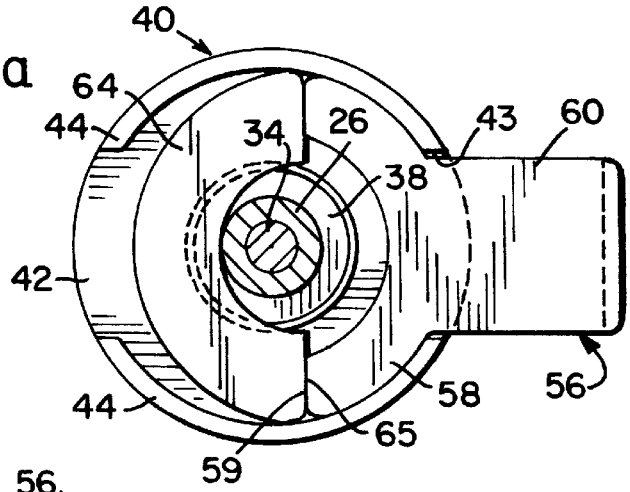
FIG. 4(*a*) is a cross sectional view taken along the line A—A of FIG. 3.
Figure 4B:
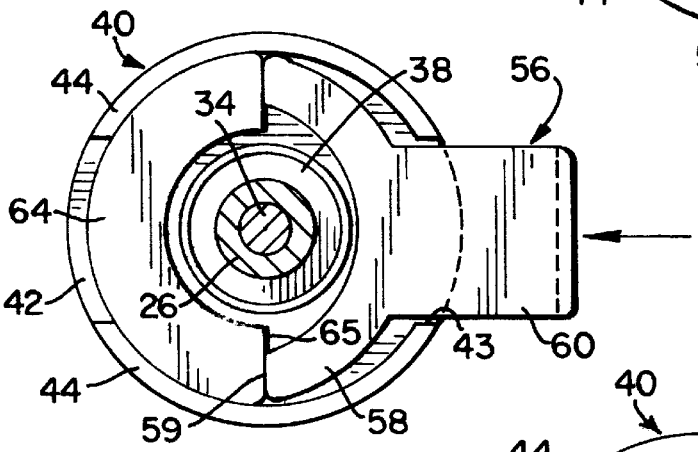

The engaging member 64 has the same configuration as of the half-moon portion 58 of the slider 56. The engaging member 64 is completely housed in the housing space, as shown in FIG. 4(*a*). On one plane in the housing space, the engaging member 64 and the slider 56 (in particular, the half-moon portion 58 thereof) are disposed so that their respective ends face with each other as shown in the drawing. The engaging member 64 and the half-moon portion 58 of the slider 56 can contact each other at their respective end portions. The engaging member 64, in the housing space, can be moved from outside of the housing space by operating the lever 60 of the slider 56 and thereby moving the half-moon portion 58 in the housing space. The engaging member 64 must be made of magnetic material so that it can lock the combination of the first and the second assemblies when they are combined. Details will be described later.

In order to operate the slider 56 and the engaging member 64, the annular rim 44 of the annular frame 40 is formed to have a pair of openings each being located on opposing position with the same size approximately. The opening 43 (shown in FIG. 4(*a*) clearly) is used to expose the end portion of the lever 60 to outside. The lever 60 can be moved only along a direction substantially normal to the opening 43. Another opening 42 is used to release a lock condition when the engaging member 64 falls into undesired lock condition in the housing space for some reason.

The opening 42, however, is not necessarily required and may be omitted. These opening may be used to drain plating solution when the plating is applied to the second assembly.

The retainer 48 is attached onto the other side of the annular frame 40 with respect to the slider 56 and the engaging member 64. The retainer 48 is fixed to the annular frame 40 using the same method as the retainer 14 is fixed to the annular plate 10. Retainer 48 has approximately the same shape as retainer 14 which is fixed to the annular plate 10 with an exception of the size of a hole 50 formed on a central portion thereof. That is, the retainer 48 comprises an annular portion 52 and two fixing portions 54 which extend upward from both sides of said annular portion 52. The annular portion 52 is used to be fixed to the annular frame 40, while the fixing portions 54 are used to fix the second assembly to an object, such as the main body or lid of a handbag. As the retainer 14 fixed to the annular plate 10, the retainer 48 may be formed in one body with the annular frame 40.

When the retainer 48 and the annular frame 40 are aligned, the hole 50 of the retainer 48 and the hole 46 of the annular frame 40 are aligned and thereby an aligning hole is formed. The hole 50 of the retainer 48 is not needed necessarily, which is different from the hole 46 formed an the annular frame 40, and may be omitted. When the hole 50 is formed, total thickness of the combined first and second assemblies can be made thinner by receiving the engaging pin 34, especially the head 38 thereof, into said hole 50 as described later. Into said hole 50, top surface portion of the head 38, whose diameter is made smaller, may be inserted.

Attracting plate 66 is fixed to one side of the annular frame 40. This surface of the annular frame 40 is the same surface as that for holding the slider 56 and the engaging member 64 thereon. Since the attracting plate 66 and the annular frame 40 are fixed with each other by the annular rim 44 of the annular frame 40, the housing space of the annular frame 40 can be maintained after fixing. When the attracting plate 66 is fixed to the annular frame 40, they are approximately aligned on a line and a closed housing space is formed there between. The attracting plate 66 may be fixed to the annular frame 40 by welding, bonding or other appropriate methods.

The attracting plate 66 is made of magnetic material. Thereby, it is affected by magnetic force. As described later, when the first assembly and the second assembly are combined with each other, the attracting plate 66 functions as a yoke and has a great effect on the motion of the engaging member 64. The hole 68 formed on a central portion of the attracting plate 66 is a hole for the head 38 of the engaging pin 34 to penetrate there through. When the attracting plate 66 is aligned with the annular frame 40 and the retainer 48, all of these holes are aligned to form an aligning hole.

An annular guide portion 70 having predetermined height is formed on a periphery of the other surface of the attracting plate 66 with respect to the slider 56 and the engaging member 64. As shown in FIG. 3, when the first and the second assemblies are combined with each other, the cover 30 is fitted into this annular guide portion 70. The annular guide portion 70 facilitates a combining operation of the first and the second assemblies, and, at the same time, ensures the mutual fitting position thereof and thereby enforces an attracting force between the first and the second assemblies. This annular guide portion 70, however, might be eliminated.

There will now be described the locking motion which occurs when the first and the second assemblies are combined with each other with reference to FIG. 3. FIG. 3 shows a cross sectional view along the center line of the magnetic fixing unit according to the present invention illustrating a combined condition of the first and the second assemblies.

As being obvious, a combining motion between the first and the second assemblies is accomplished by a magnetic operation between a plurality of components of the first and the second assemblies. However, it might be said briefly that the combining motion is accomplished by the attracting plate 66 of the second assembly being attracted by the ring magnet 22 of the first assembly.

When the first and the second assemblies come near to each other, and the distance there between is less than a certain range, these assemblies are clicked together in an instant. When the first and the second assemblies are completely combined each other, the upper portion of the cover 30 of the first assembly is fitted into the annular guide portion 70 of the attracting plate 66 of the second assembly and the engaging pin 34 and the cylindrical sleeve 26 which are projected out on the top of the first assembly are inserted into the aligning hole 68 of the second assembly. At that time, the head 38 of the engaging pin 34 reaches up to the hole 46 formed on the annular frame 40 of the second assembly and at least a top end portion of the cylindrical sleeve 26 penetrates through it he closed housing space formed between the annular frame 40 and the attracting plate 66.

In addition, the magnetic fixing unit of the present invention offers a great advantage that the combination of the first and the second assemblies is automatically locked when they are combined together. The automatic locking is accomplished by a cooperative magnetic operation among the annular plate 10, the ring magnet 22, the cylindrical sleeve 26, the attracting plate 66 and the engaging member 64. Specifically, the magnetic operation between the annular sleeve 26 and the engaging member 64 could be described, since the cylindrical sleeve 26 is magnetized by the magnetic force generated by the ring magnet 22 through the annual plate 10 and thereby also generates magnetic force, the engaging member 64 made of magnetic material is attracted to the outer surface of the magnetized cylindrical sleeve 26. As a result, the aligning hole of the second assembly is made narrower or partially closed, by the engaging member 64, and since there occurs an interference between the engaging member 64 and the engaging pin 34, in particular, between the engaging member 64 and the reverse surface of the head 38 of the engaging pin 34 when the combination between the first and the second assemblies is attempted to be release, the combination between the assemblies cannot be released. That is, the first and the second assemblies are left in the automatically locked condition.

The attraction of members 64 t cylindrical sleeve 26 may raise a question that will now be explained. That is, generally, when the first and the second assemblies are combined under these condition, the attracting plate 66 of the second assembly is supposed to be magnetized by the ring magnet 22 of the first assembly and thereby to generate magnetic force, and, as a result, the engaging member 64 is supposed to be attracted also to the attracting plate 66 and thereby not to be smoothly attracted to the cylindrical sleeve 26. In the present invention, however, the engaging member 64 can be smoothly attracted to the cylindrical sleeve 26 in spite of said engaging member 64 being attracted to the attracting plate 66. The motion of the engaging member 64 results from the various effects of the magnetic forces in various components as described above, and the inventor of the present invention describes the principle of these combined magnetic forces as follows.

In order to describe this principle, the ring magnet 22 is assumed to have the S-magnetic pole on the surface of the annular plate 10 side thereof and the N-magnet pole on the other side. As being obvious, magnetism from the S-pole is gathered onto near the end portion of the cylindrical sleeve 26 by the operation of the annular plate 10, which functions as a yoke, and the cylindrical sleeve 26, and generates the strongest magnetic force near this end portion. On the contrary, magnetism from the N-pole is gathered onto the attracting plate 66, in particular onto the outer periphery thereof (the annular guide portion 70 when it is formed) by the attractive plate 66 which functions as a yoke, and a flow of magnetism toward the S-pole is generated in this outer periphery portion. When the annular guide portion 70 is provided, more flow of magnetism is generated by this annular guide portion 70. The magnetism on the attracting plate 66 is made weaker as this flow of magnetism is generated more and thereby the attracting force applied to the engaging member 64 is made weaker. As a result, since the magnetic force near to the end portion of the cylindrical sleeve 26 where the magnetism is gathered approximately to one point is greater than that on the attracting plate 66 where the magnetic force is reduced by the generation of the magnetic flow, the engaging member 64 can be smoothly attracted and attached to the cylindrical sleeve 26 having more magnetic force though said engaging member 64 being attracted by the attraction plate 66.

However, due to the shape of the ring magnet 22, even if the attracting plate 66 is not provided, magnetic leakage occurs on the outer periphery of the ring magnet 22. Thus, when the attracting plate 66, which is made of magnetic material and functions as a yoke is provided, more magnetic flow may be generated from the outer periphery thereof as compared with the case provided with no attracting plate. This makes weaker an attracting force of the attracting plate 66 applied to the engaging member 64, and, at the same time, makes stronger an attracting force applied between the first and the second assemblies.

When, contrary to the present invention, the attracting plate 66 made of magnetic material is not provided, since the engaging member 64 is attracted to the attracting plate 66 by the magnetic force generated by the ring magnet 22 with much stronger force, the engaging member 64 cannot be moved, or can be attracted and attached to the cylindrical sleeve 26 only when the engaging member comes very close to the cylindrical sleeve 26. As a result, an automatic locking of the present invention can not be performed substantially. This phenomenon has been examined by the inventor of the invention. Accordingly, the fact that the attracting plate 66 is made of magnetic material is an important element of the present invention.

As described above, even if the engaging member 64 is in a position where it covers the aligning hole of the second assembly when the first and the second assemblies are attempted to be combined to each other, since the attracting force of the attracting plate 66 applied to the engaging member 64 is made weaker, the engaging member 64 can be easily removed from such position through the contact between the engaging member 64 and the first assembly. In particular, the head 38 of the engaging pin 34 thereof will be able to move the engagement member 64 from this position where it covers the aligning hole of the second assembly, and thus complete the combining operation. However, after the engaging member 64 is once removed from the blocking position, it will then automatically be attracted and attached to the cylindrical sleeve 26 to complete the automatic locking.

According to the construction of the present invention described above, the magnetic fixing unit of the present invention may be made more compact and thinner than the conventional magnetic fixing units. This is because, in the conventional magnetic fixing unit, since the engaging member is attracted onto the attracting plate by stronger force, large tapered surface has to be formed on a head of the engaging pin to make smaller the contacting resistance between the head and the engaging member in order to remove the engaging member from the obstructing position of the aligning hole of the second assembly. Whereas, in the magnetic fixing unit of the present invention, since the attracting force of the attracting plate applied to the engaging member is made smaller, such a large tapered surface is not required, and therefore smaller tapered surface comparing with the conventional fixing unit is sufficient therefor. Thus, the magnetic fixing unit of the present invention may be made more compact and thinner than the conventional magnetic fixing unit by a decreased amount of tapered surface of the head.

FIG. 4(*a*) is a cross sectional view taken along the line A—A of FIG. 3. This drawing shows the relative arrangement of the engaging member 64, the slider 56 and nearby components in a lock position and a release position, wherein FIG. 4(*a*) shows a relative arrangement in the lock position and FIG. 4(*b*) shows that of the release position respectively.

As being obvious from FIG. 4(*a*), in the lock position, the engaging member 64 is disposed in a position where the engaging member 64 is attracted and attached to the outer surface of the cylindrical sleeve 26. As a result, when the combination between the first and the second assemblies is attempted to be released (that is, when the engaging pin 34 is attempted to be moved perpendicularly upward on the drawing), the locking condition cannot be released because the head 38 of the engaging pin 34, in particular, the portion thereof shown by a broken line interferes with the engaging member 64.

In order to release this lock condition, as shown in FIG. 4(*b*), the engaging member 64 should be moved to, at least, outside of the periphery of the head 38 of the engaging pin 34. The engaging member 64 can be moved by moving the slider 56 along an arrow direction shown on the drawing. When the slider 56 is moved along the arrow direction, an end portion 59 of the half-moon portion 58 of the slider S6 is brought into contact with an end portion 6S of the engaging member 64 so as to move the engaging member 64 outwardly, and thereby the interference between the engaging pin 34 and the engaging member 64 is released. That is, the lock condition is released. In order to avoid an interference between the half-moon portion 58 of the slider S6 and the head 38 of the engaging pin 34 at this release position, an inner boundary of the half-moon portion 58 is recessed inward deeper than that of the engaging member 64.

Figure 5A:
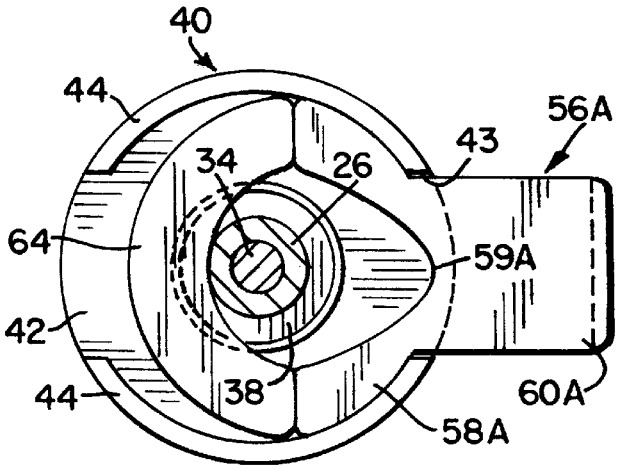
FIGS. 5(*a*) and 5(*b*) show another embodiment of the engaging member and the slider.
Figure 5B:
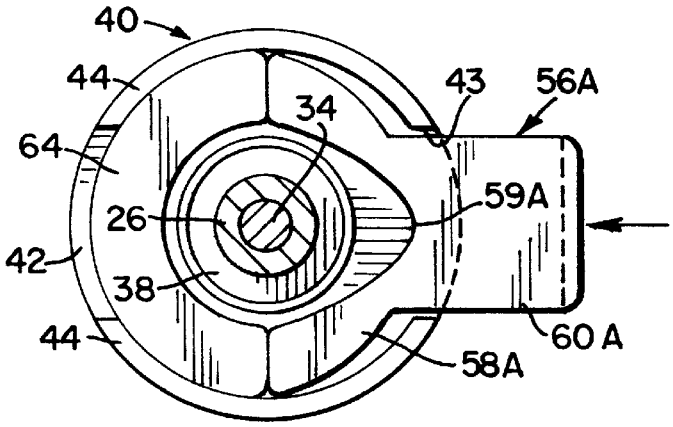

FIGS. 5(*a*) through 6(*b*) show other embodiments of the engaging member and the slider in the same way as of FIGS. 4(*a*) and 4(*b*). Among these, in FIGS. 5(*a*) and 5(*b*), the engaging member and the slider are formed into separated pieces and both are made of magnetic materials, and, in FIGS. 6(*a*) and 6(*b*), the engaging member and the slider are formed in one body using magnetic material.

As shown in FIG. 5(*a*), when the slider 56A is made of magnetic material, the sliders 56A as well as the engaging member 64 is attracted to the magnetized cylindrical sleeve 26. However, when the slider 56A has been attracted to the cylindrical sleeve 26, the engaging member 64 is pushed out of the through hole of the second assembly, and thereby locking operation is disabled. Accordingly, when the slider 56A is made of magnetic material, the engaging member 64 should be surely attracted and attached to the cylindrical sleeve 26. Therefore, in the present embodiment, the inner boundary of the half-moon portion 58A of the slider 56A is recessed more deeply than that of the embodiment shown in FIGS. 1 to 4(*b*). As described previously, since the slider 56A is designed to be movable along only a direction substantially normal to the opening 43 and is formed to be approximately symmetrical, the most effective magnetic force to attract the slider 56A to the cylindrical sleeve 26 among those applied from the cylindrical sleeve 26 to the slider 56 is substantially generated near to a central portion (hereafter, referred to as a magnetic point of application) 59A of the inner boundary of the half-moon portion 58A of the slider 56A. Accordingly, when this central portion is recessed deeper, that is, when the magnetic point of application 59A is made farther from the cylindrical sleeve 26, the magnetic force of the cylindrical sleeve 26 applied to the half-moon portion 58A is made smaller than that applied to the engaging member 64, and thereby the engaging member 64 can be surely attracted and attached to the cylindrical sleeve 26.

In addition, when the slider 56A is made of magnetic material, the slider 56A as well as the engaging member 64 is also attracted to the attracting plate (not shown). However, when the slider 56A is attracted to the attracting plate with too much stronger force, the engaging member 64 cannot be smoothly attracted to the cylindrical sleeve 26. Therefore, in, the present embodiment, the attracting force applied between the attracting plate, and the slider 56A and the engaging member 64 must be differentiated by some means. For this purpose, in the present embodiment, a gap member (not shown) made of non-magnetic material is inserted between the attracting plate, and the slider 56A or the engaging member 64. Though the slider 56A and the engaging member 64 are attracted onto the attracting plate to some degree, they can be smoothly moved on the attracting plate owing to the gap member inserted there between. This has been experienced by the inventor of the present invention.

In addition, instead of inserting a gap member that is of non-magnetic material, non-magnetic plating applied to the engaging member 64, the slider 56A and/or the attracting plate may provide the same kind of effect. As is well known, the thickness of the plating can be controlled by a dipping period into the plating solution, and therefore when an appropriate thickness of plating is applied to the engaging member 64 or the slider 56A, the same effect as that described above might be provided.

Figure 6A:
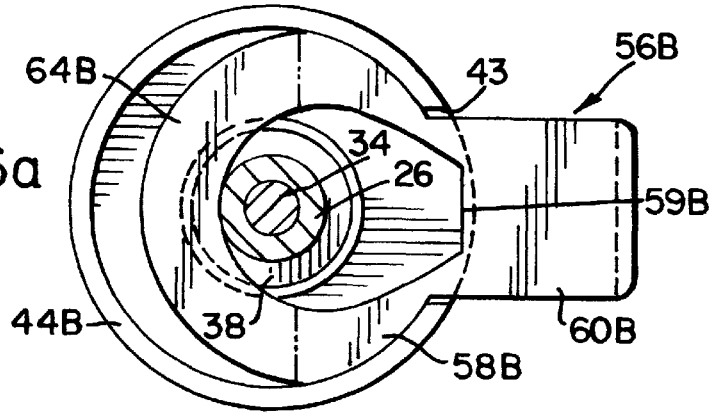
FIGS. 6(*a*) and 6(*b*) show a further embodiment of the engaging member and the slider.
Figure 6B:
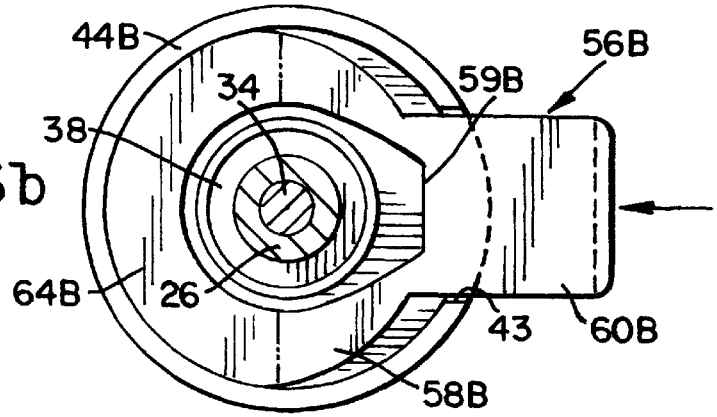

To an embodiment shown in FIGS. 6(*a*) and 6(*b*), the same concept as of that shown in FIGS. 5(*a*) and 5(*b*) could be applied. In this embodiment, a portion 64B which corresponds to the engaging member and a portion 58B which corresponds to the slider are formed into an integrated body. A boundary between these two portions is shown by a two-dot chain line in FIG. 6(*a*). In this embodiment, as that of the FIG. 5(*a*), the inner boundary of the portion 58B, which corresponds to the half-moon portion, is recessed deeper so that a magnetic point of application 59B is to be further from the cylindrical sleeve 26, and thereby the portion 64B which corresponds to the engaging member is surely attracted to the cylindrical sleeve 26. In addition, in order to decrease the attracting force between the integrated body and the attracting plate (not shown), a gap member made of non-magnetic material is inserted between the integrated body and the attracting plate, which ensures smooth movement of the integrated body.

Though, in these points described above, the embodiment of FIGS. 6(*a*) and 6(*b*) has no difference from that of FIGS. 5(*a*) and 5(*b*), the embodiment of FIGS. 6(*a*) and 6(*b*) additionally provides some effects which will not be obtained from other embodiments.

According to the embodiment shown in FIGS. 6(*a*) and 6(*b*), since the portion 64B which corresponds to the engaging member and the portion 56B which corresponds to the slider are formed into an integral body, manufacturing cost may be controlled to be lower than the case of separated components. Further, according to the embodiment shown in FIGS. 6(*a*) and 6(*b*), the engaging member 64 cannot fall into undesired lock condition in the housing space. Though, as described previously, other embodiments employs the opening (which is designated by reference numeral 42 in FIGS. 2 or 4(*a*)) on the engaging member side of the annular rim of the annular frame in order to prepare for the undesired lock condition, in the embodiment of FIGS. 6(*a*) and 6(*b*), the portion 64B which corresponds to the engaging member can be moved in one unit with the portion 56B which corresponds to the slider owing to the integral formation of the portion 64B which corresponds to the engaging member and the portion 56B which corresponds to the slider, and accordingly the portion 64B which corresponds to the engaging member cannot fall into undesired lock condition. That is, even if the portion 64B which corresponds to the engaging member falls into undesired lock condition, the lock condition can be easily released by moving the portion 56B which corresponds to the slider. Accordingly, in this embodiment, the opening (42) may be eliminated also. Therefore, this embodiment employs only one opening. In addition, the embodiment of FIGS. 6(*a*) and 6(*b*) offers another advantage that the undesired lock condition can be released more easily comparing 30 with the case where the engaging member and the slider are provided separately.

Figure 7:
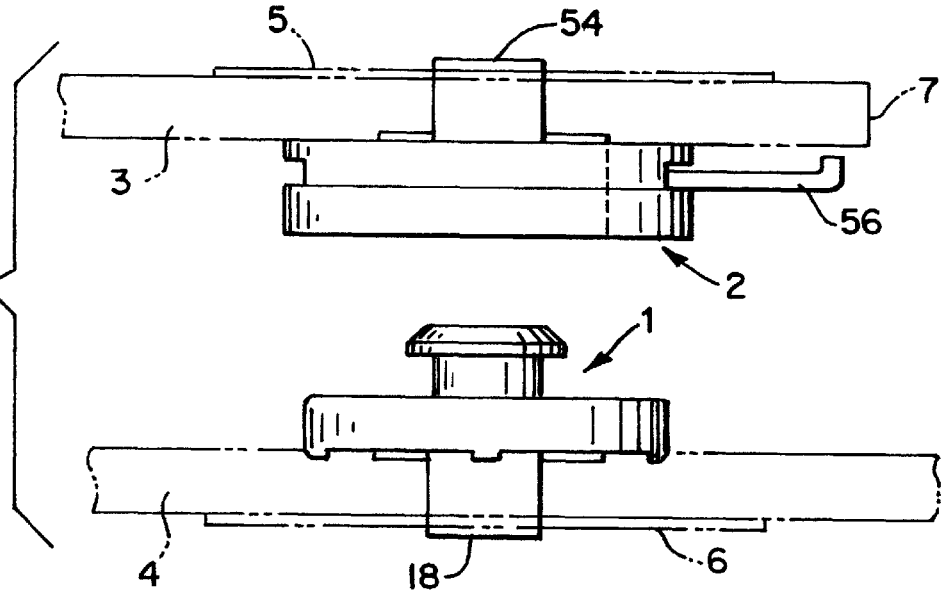
FIG. 7 shows an example in practical use of the magnetic fixing unit of the present invention.

Finally, some examples in practical usage of the magnetic fixing unit of the present invention will be described with reference to FIG. 7. The magnetic fixing unit of the present invention may be applied to various objects such as handbag, bag, knapsack, door and the like. There will be employed herein the handbag as a typical example. FIG. 7 is an enlarged side elevational view of the first and the second assemblies, each being attached to the handbag, Accompanied with parts of the handbag.

According to the present embodiment, the first and the second assemblies are fixed to a right side of a handbag main body and a reverse side of a lid of the handbag respectively. In contrast with this, the first assembly may be fixed to the lid of the handbag and the second assembly may be fixed to the handbag main body respectively.

These assemblies are respectively fixed to predetermined places by the retainers 48, 14 installed on respective assemblies. As described above, each of these retainers 48, 14 respectively has two fixing portions 54, 18 (shown in FIGS. 1 and 2 clearly), and a pair of holes (not shown) for inserting respective fixing portions is formed on corresponding portions of the lid 3 and the main body 4 respectively. The first and the second assemblies can be fixed to the lid 3 and the main body 4 respectively by completely inserting respective fixing portions 54, 18 into these holes and then bending them outward (or inward). Generally, in order to ensure fixing, washers 5, 6 are placed between the fixing portion 54 and the lid 3 and between the fixing portion 18 and the main body 4 respectively. On these washers 5, 6 are formed holes corresponding to those formed on the lid 3 and the main body 4. When the washers are used, respective fixing portions 54, 18 of the retainers are inserted into the hole formed on the lid 3 and the hole of the washer or into the hole formed on the main body and the hole of the washer respectively in this order, and then are bent.

When the first and the second assemblies which have been respectively fixed to the main body 4 and the lid 3 are combined with each other, that is, when the lid of the handbag is closed, the first and the second assemblies are located between the main body 4 and the lid 3 of the handbag and thereby can hardly be seen from outside. The combination between the first and the second assemblies is released by inserting a finger into a clearance between the main body 4 and the lid 3 and pushing the lever 56 of the second assembly. In order to facilitate this operation, it is preferable that the second assembly is fixed, as shown in the drawing, near to an edge 7 of the lid 3.

Though not shown in the drawing, the lid and the main body are formed by folding at least two sheets of leather or cloth and bent portions of respective fixing portions 54, 18 are located between respective folded sheets. Accordingly these fixing portions cannot be seen from outside.

According to the fixing method described above, since these assemblies are not exposed substantially to the outside, the magnetic fixing unit of the present invention allows various decorations (not shown) to be applied to any favorite place on by user's preference. Conventionally, since the fixing unit is exposed to the outside, said fixing unit has restricted a design to some degree, so that the user's preference cannot be sufficiently reflected. In contrast with this, the present invention allows to choice the design freely.

There has been described an example of practical usage of the magnetic fixing unit of the present invention by taking the case of the handbag, and the magnetic fixing unit of the present invention can be used not only for the handbag but also for knapsack, bag, knob of the door and any other objects which require to be locked. Therefore, the objects to which the magnetic fixing unit of the present invention is attached are not limited.

In the embodiment described above, when the components are to be made of non-magnetic material, non-magnetic plating may be applied to those components, instead of being made by non-magnetic material, to induce therefrom the same effect as that of the components made of non-magnetic material. Therefore, in respective embodiments, the component to be made of nonmagnetic material may be replaced by the magnetic component to which non-magnetic plating is applied or that coated by nonmagnetic material.

In each of the embodiments described above, the engaging member may be moved directly without using slider, instead of being moved through the slider, by forming a tongue on the engaging member itself, which is similar to that formed on the slider, that is, by forming the slider as a part of the engaging member. To add to that, the lock condition can be released by pulling the tongue formed as a part of the engaging member so as for the engaging member to—be disengaged from the cylindrical sleeve. Accordingly, in this case, different from the above mentioned embodiment in which the lock condition is released by a pushing operation (of the slider), the lock condition is released by a pulling operation (of the engaging member).

In addition, the ring magnet need not be necessarily installed on the first embodiment but may be installed on the second assembly. What is important to the present invention is the fact that the magnetic member is installed between the ring magnet and the slider or the engaging member.

Further, the magnetic fixing unit of the present invention has been described as of approximately cylindrical shape as a whole, it need not be necessarily cylindrical but may take various shapes such as square or other ones as a whole.

EFFECT OF THE INVENTION

The present invention provides a practical and simplified magnetic fixing unit which allows a closed condition to be automatically locked using only magnetic characteristic.

What is claimed is:

1. A magnetic fixing unit comprising:

a first assembly which is attached to one member of a pair of members which are to be combined to each other; and a second assembly which is attached to the other member of the pair of members;

the first assembly comprises at least a fixing plate and an engaging portion formed on said fixing plate;

said second assembly comprises at least a magnetic plate which faces said fixing plate on one surface thereof when said second assembly is combined with said first assembly, an engaging member which is made of magnetic material and is located on an opposing side of said magnetic plate facing away from said one surface of said fixing plate and may be moved to a lock position for engaging said engaging portion when said second assembly is combined to said first assembly, and a release means which is applied to said engaging member to move said engaging member from said lock position to a release position; and a magnet plate which is located between said fixing plate and said magnetic plate when said first and said second assemblies are combined with each other is disposed on either of said first and said second assemblies, and said engaging member is designed to be movable to the lock position for engaging said engaging portion by an operation of said magnet plate, and a substantially all of said magnet plate is placed between a plane formed by said fixing plate and an extension thereof and another plane formed by said magnetic plate and an extension thereof when said first and said second assemblies are combined with each other.

2. A magnetic fixing unit as claimed in claim 1, in which said magnet plate is installed on said fixing plate.

3. A magnetic fixing unit as claimed in claim 1, in which said fixing plate is made of magnetic material.

4. A magnetic fixing unit as claimed in claim 1, in which a non-magnetic member is inserted into at least one of places between said release means and said magnetic plate, between said engaging member and said magnetic plate and between a set of said release means and said engaging member, and said magnetic plate.

5. A magnetic fixing unit as claimed in claim 4, in which said non-magnetic member is a plating applied to at least one of said release means, said engaging member and said magnetic plate.

6. A magnetic fixing unit as claimed in claim 1, in which said release means is a slider formed as a separated piece from said engaging member.

7. A magnetic fixing unit as claimed in claim 6, in which said engaging member and said slider are formed in one body.

8. A magnetic fixing unit as claimed in claim 7, in which said release means is made of magnetic material and a magnetic operating force applied by said engaging portion to said release means is reduced by recessing a part of said release means deeper toward farther direction from said engaging portion.

9. A magnetic fixing unit as claimed in claim 6, in which said release means is formed as a part of said engaging member.

10. A magnetic fixing unit comprising:

a first assembly which is attached to one member of a pair of members which are to be combined to each other; and a second assembly which is attached to the other member of the pair of members;

the first assembly comprises at least a fixing plate which is made of magnetic material and is fixed to said one member, and an attracting portion for engaging and engaging member, which is made of magnetic material and extends upward from said fixing plate, and an engaging portion formed on said attracting portion;

said second assembly comprises at least a frame fixed to the other member of said pair of members; said engaging member which is engaged by said attracting portion being made of magnetic material and is installed on said frame to be movable, release means for moving the engaging member from a lock position to a release position and movable with respect to said frame, and an attracting plate which is made of magnetic material and is installed on said frame to place said engaging member and said release means between said frame and said attracting plate; and a magnet plate is disposed on either of said first or said second assemblies so that said magnet plate is located between said fixing plate and said attracting plate when said first and said second assemblies are combined to each other, said attracting plate is formed into a shape which allows said engaging portion and said attracting portion of said first assembly to approach nearby said engaging member when said first and said second assemblies are combined toward said attracting portion for engaging said engaging member in said frame by cooperative magnetic operation of said fixing plate, said magnet plate, said attracting portion and said attracting plate to be engaged with said engaging portion, and thereby locks a combination of said first and said second assemblies in a lock condition, and said lock condition can be released by moving said release means to be applied to aid engaging member and substantially all of said magnet plate is place between a plane formed by said fixing plate and an extension thereof and another plane formed by said attracting plate and an extension thereof when said first and said second assemblies are combined to each other.

11. A magnetic fixing unit as claimed in claim 10, in which said magnet plate is placed on said fixing plate and said attracting portion for engaging member is extended upward from said fixing plate through said magnet plate.

12. A magnetic fixing unit as claimed in claim 10, in which said fixing plate is made of magnetic material.

13. A magnetic fixing unit as claimed in claim 10, in which a non-magnetic member is inserted into at least one of places between said release means and said attracting plate, between said engaging member and said attracting plate and between a set of said release means and said engaging member, and said attracting plate.

14. A magnetic fixing unit as claimed in claim 13, in which said non-magnetic member is a plating applied to at least one of said release means, said engaging member and said attracting plate.

15. A magnetic fixing unit as claimed in claim 10, in which said release means is a slider formed as a separated piece from said engaging member.

16. A magnetic fixing unit as claimed in claim 15, in which said engaging member and said slider are formed in one body.

17. A magnetic fixing unit as claimed in claim 10, in which said release means is formed as a part of said engaging member.

18. A magnetic fixing unit as claimed in claim 1, in which said release means is made of magnetic material and a magnetic operating force applied by said attracting portion for engaging member to said release means is reduced by recessing a part of said release means deeper toward farther direction from said attracting portion for engaging member.

* * * * *